United States Patent [19]

Lewis

[11] 4,333,287

[45] Jun. 8, 1982

[54] SYSTEM OF LATTICE TILES

[75] Inventor: Marlan M. Lewis, 6036 Ridgecrest, Dallas, Tex. 75231

[73] Assignee: Marlan M. Lewis, Dallas, Tex.

[21] Appl. No.: 154,585

[22] Filed: May 29, 1980

Related U.S. Application Data

[63] Continuation of Ser. No. 930,377, Aug. 2, 1978, abandoned.

[51] Int. Cl.[3] ..... B44F 7/00

[52] U.S. Cl. ..... 52/311; 52/663; D25/91

[58] Field of Search ..... 52/311, 663; D25/91

[56] References Cited

U.S. PATENT DOCUMENTS 1,669,211 5/1928 Scherer ..... 52/669

2,099,149 11/1937 Turnquist ..... 52/590

2,895,717 7/1959 De Falco ..... D25/91

3,058,266 10/1962 Harvey ..... 52/663

*Primary Examiner*—Price C. Faw, Jr.

*Assistant Examiner*—Carl D. Friedman

*Attorney, Agent, or Firm*—Hubbard, Thurman, Turner, Tucker & Glaser

[57] ABSTRACT

A system of tiles for constructing a decorative lattice is disclosed. A basic square section of tile is formed of crossed strips, framed by a border which is much thinner than the strips. The strips are arranged in such a way that when several of the square sections are placed together, the strips appear to run from one tile to the next. In addition, there are tiles comprising various portions of the square section which may be arranged to form arches and other curved shapes.

2 Claims, 7 Drawing Figures

SYSTEM OF LATTICE TILES

This is a continuation of application Ser. No. 930,377, filed Aug. 2, 1978 now abandoned.

BACKGROUND OF THE INVENTION

This invention relates to a system of tiles for constructing a decorative lattice.

Lattices made of crossed strips have often been used as decorations for outdoor areas such as gardens. They have also been used as indoor decorations, reminiscent of a garden. Particularly when used indoors, a lattice must be custom made to fit the constraints of the room in which it is placed. In general, this causes such decorations to be relatively expensive compared to mass-produced articles. The present invention provides a way in which the economics of mass production can be applied to the use of such decorative structures.

SUMMARY OF THE INVENTION

In accordance with the present invention, there is provided a tile which comprises a section of lattice, whereby a plurality of such tiles may be installed together to form a lattice, as upon a wall. In one embodiment, there are also provided tiles which can be assembled to form a lattice arch and other curved structures.

The tiles of the present invention can be manufactured in quantity, but assembled to suit any particular area where they are used for decoration. Not only does such a modular system allow adjustment to the size of an area, but a variety of overall designs may be employed as well.

DESCRIPTION OF THE PREFERRED EMBODIMENT

Figure 1:
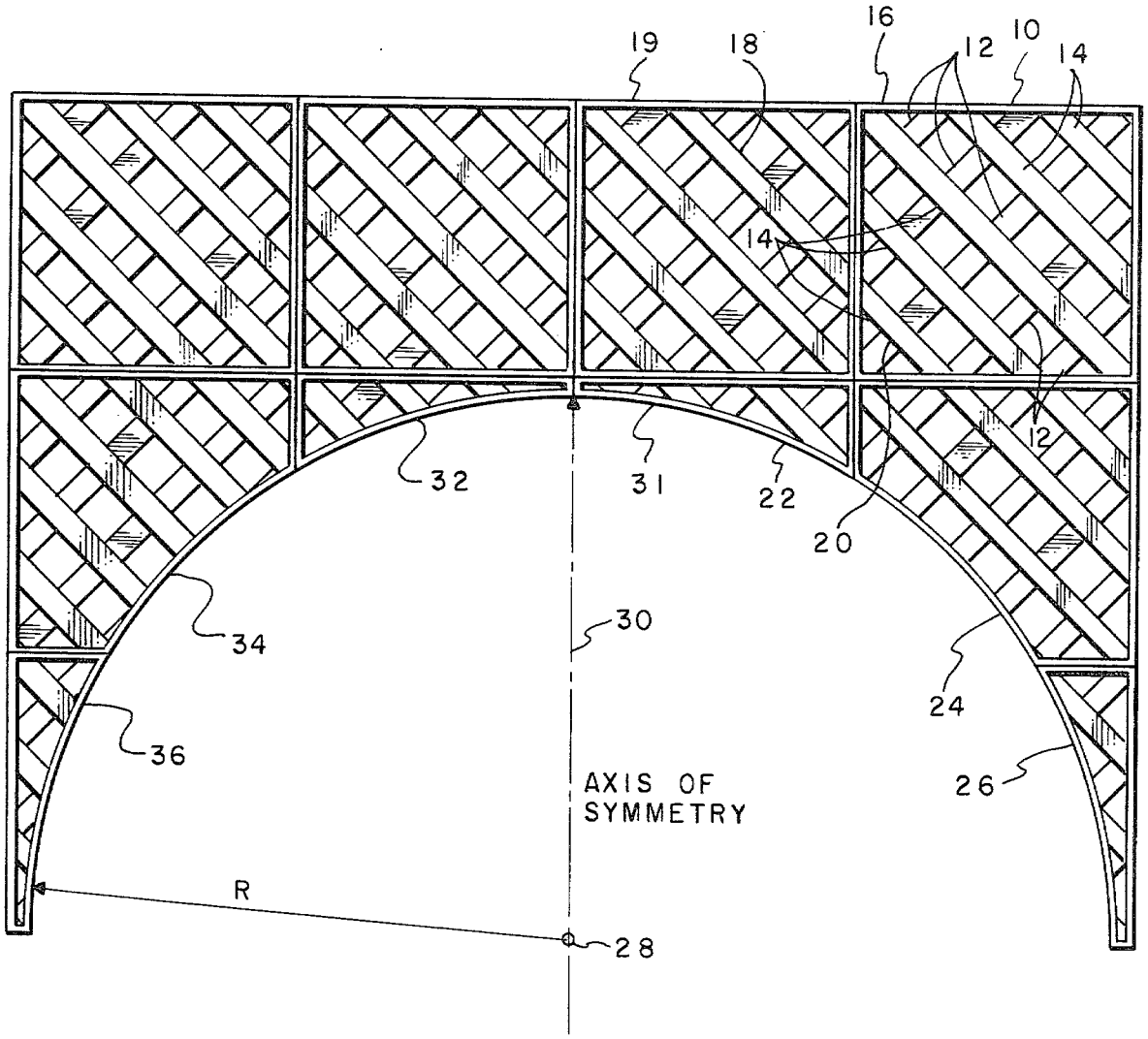
FIG. 1 is an elevation view of a system of lattice tiles according to the invention.

In FIG. 1, there are illustrated components of a lattice tile system according to the invention. The basic tile 10 is in the form of a square section. A plurality of separated parallel strips 12 are disposed symmetrically with respect to the diagonals of the square section. In the tile shown, one of the strips 12 lies on a diagonal of the square section. A second plurality of strips 14, likewise symmetrical with respect to the diagonals of the square, are attached across the strips 12 to form a lattice design. Around the tile 10 is attached a border 16, much thinner than strips 12 and 14, giving the tile a neat appearance and making it simple to handle and install.

It is an important feature of the invention that strips in one of the tiles have the appearance of being continuations of strips in adjacent tiles. For example, strip 18 of tile 19 appears to be a continuation of strip 20 of tile 10.

The tiles may be fabricated from a number of materials. For example, wood may be used for strips 12 and 14 and border 16, the pieces being assembled using adhesive. Various wood substitues such as fibreboard can be used in the same way. Alternatively, the entire unit can be molded in plastic.

FIG. 1 also illustrates three additional tiles which can be used to form an arch. Tiles 22, 24, and 26 are each portions of the square section represented by tile 10. They include those portions of the square section which lie outside a circular arch around a centerpoint 28. The centerpoint 28 of the circular arch is on an axis of symmetry 30 and located a distance from the top of tile 22 equal to twice the length of a side of the square section of tile 10. The radius of the arch as shown in FIG. 1 somewhat less than this distance. Each of sections 22, 24 and 26 has a border like border 31 attached around the tile. Since tiles 22, 24, and 26 are portions of the square section, the strips of one tile appear to continue into the next adjacent tile as with the square section.

Tiles 22, 24 and 26 form only one half of an arch; tiles 32, 34, and 36 are required to complete the arch. Tile 32 is the same as tile 22, but installed facing oppositely in FIG. 1 in such a way as to be symmetrical with tile 22, with respect to axis 30. Similarly, tile 34 is the same as tile 24 but facing oppositely. Likewise, tile 36 is the same as tile 26 and installed symmetrically with respect to axis 30. Thus, by the use of the three kinds of tiles like tiles 22, 24, and 26, an arch may be constructed.

Figure 2:
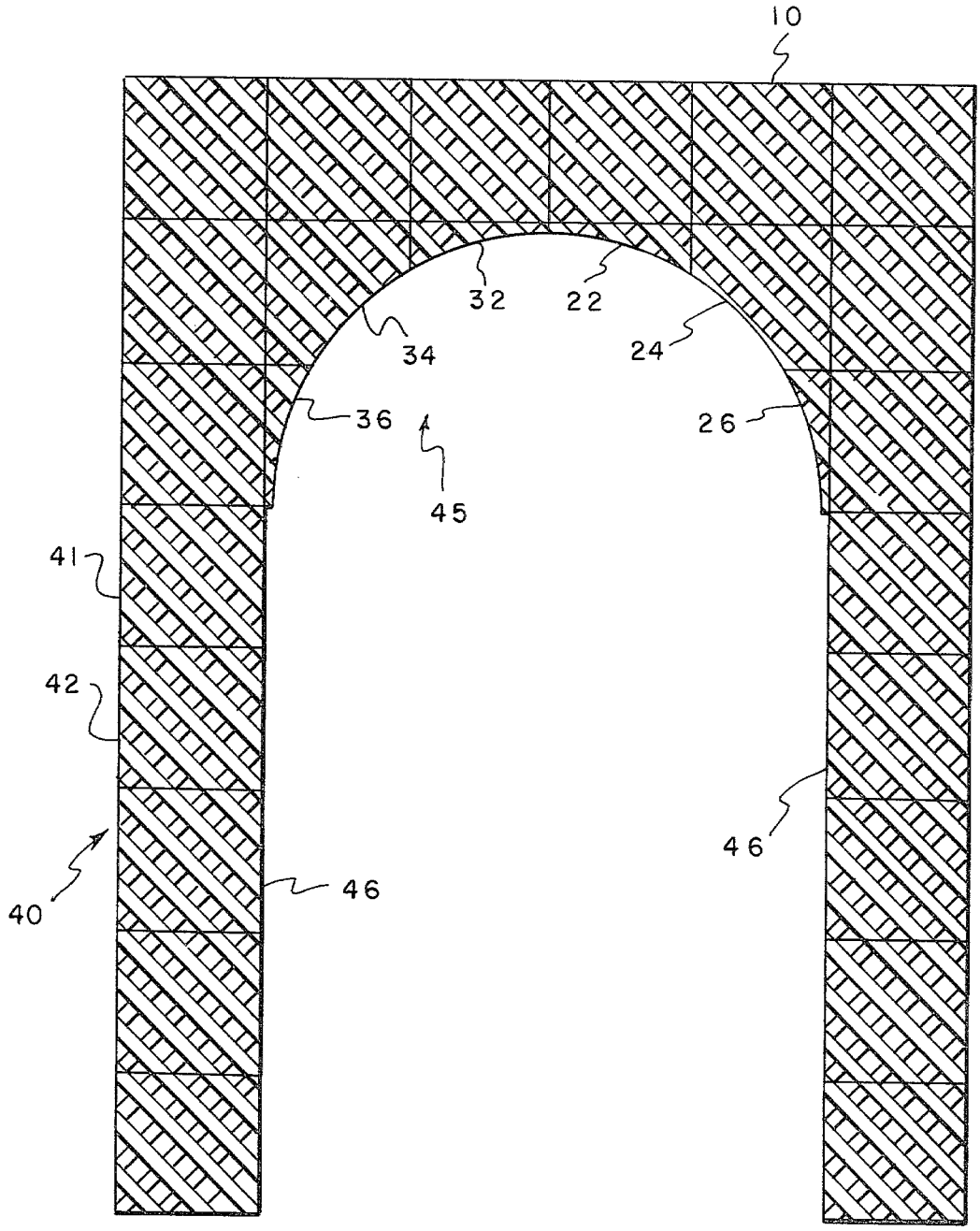
FIG. 2 is an elevation view of a lattice constructed with the system of tiles according to the invention.

FIG. 2 illustrates how tiles like tile 10, 22, 24, and 26 may be installed to form a full lattice 40. Tiles such as tiles 41 and 42 in lattice 40 are of the same type as tile 10. Because of the scale of FIG. 2, the borders of the tiles are not shown.

Figure 3:
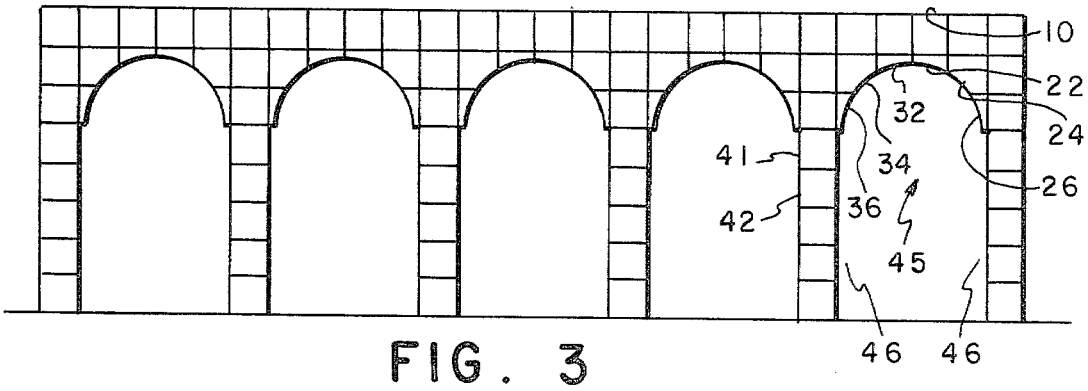
FIG. 3 is an elevation view of a second, more extensive lattice constructed with the system of tiles according to the invention.
Figure 4:
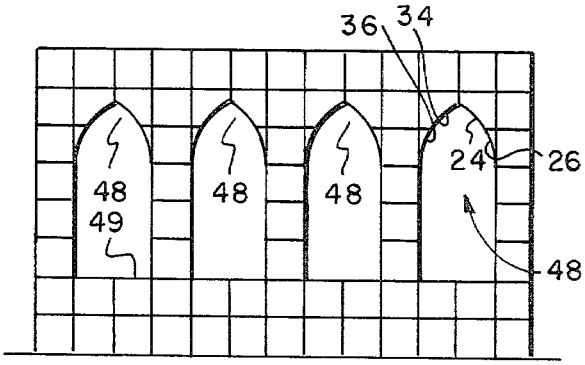
FIG. 4 is a third lattice constructed with the system of tiles according to the invention.
Figure 5:
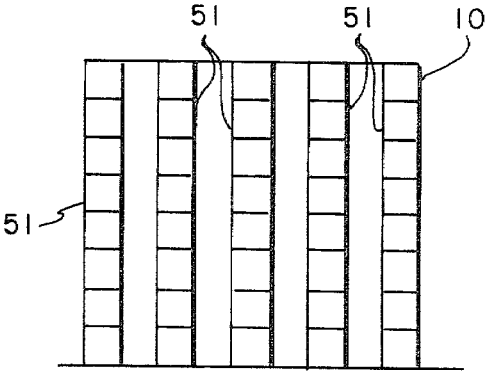
FIG. 5 is an elevation view of a fourth lattice constructed with the system of tiles according to the invention.

FIGS. 3 through 7 serve to illustrate the variety of lattice designs which can be accomplished using tiles like tiles 10, 22, 24, and 26. These lattices can be assembled against a wall, and the resultant arches and openings can, for example, be around doors or windows. In the lattice of FIG. 3, there is simply a repetition of the arch 45 and columns 46 of FIG. 2. In FIG. 4, a series of gothic arches 48 are created by eliminating the tiles like tiles 22 and 32. A base wall 49 is formed of square section tiles. FIG. 5 shows a number of columns 51 constructed from tiles like tile 10.

Figure 6:
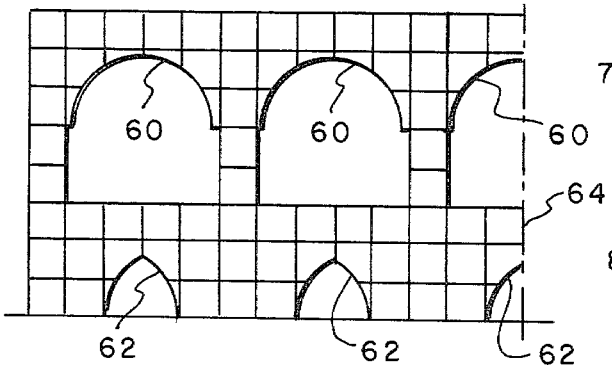
FIG. 6 is an elevation view of a fifth lattice constructed with the system of tiles according to the invention.

In FIG. 6, circular arches 60 are combined with gothic arches 62 formed in a base wall 64.

Figure 7:
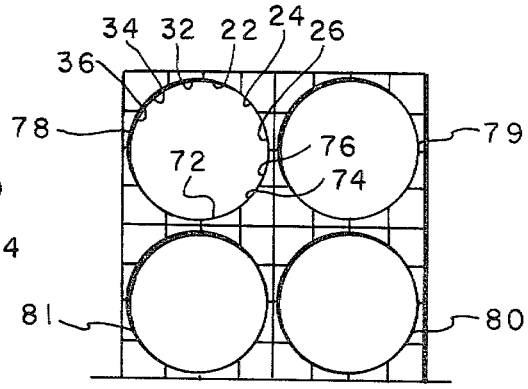
FIG. 7 is an elevation view of a sixth lattice constructed with the system of tiles according to the invention.

In FIG. 7, arches 22, 24, 26, 32, 34, and 36 are combined with symmetrically arranged tiles 72, 74, and 76 and others to form a circle 78. Similar circles 79, 80, and 81 combine to form the overall lattice.

From the illustrations given, it can be appreciated that the four basic tiles 10, 22, 24, and 26 allow the formation of a wide and useful variety of lattices. A number of variations are possible in the tiles themselves. The strips, such as strips 12 and 14 can be disposed differently within the basic square section so long as they appear to continue from one tile to the next. The shape of the arch formed by tiles like tiles 22, 24, and 26 may be varied from the circular one shown. Moreover, it may be considered desirable to use more or less than the three tiles shown to form such an arch. Consistent with all these variations, however, the tiles of the system of the invention are subject to mass production and accomodation to a variety of design environments.

Although preferred embodiments of the invention have been described in detail, it is to be understood that the various changes, substitutions, and alterations can be made therein, without departing from the spirit and scope of the invention as defined by the appended claims.

I claim:

1. A system of lattice tiles for constructing a decorative lattice, comprising:

a first tile which includes:

a first plurality of strips, a second plurality of strips attached across said first strips to form a square section of lattice with said strips disposed symmetrically with respect to the diagonals of the square so that a plurality of said tiles may be joined together with the strips of one tile appearing to be continuations of strips in adjacent tiles; and, second, third, and fourth tiles, each comprising a portion of a square section formed by said first tile, said portions being shaped to form one half of an arch when said third tile is installed adjacent to said second tile and when said fourth tile is installed adjacent said third tile, each of said tiles including a border strip around the tile and the border strip of said first tile being adapted to abut against and along an identical border strip of another tile, and at least two sides of the border strips of said second, third, and fourth tiles adapted to abut against and along an identical border strip on another tile, whereby a plurality of said tiles can be installed to form an archway.

2. A system of lattice tiles, comprising:

a first tile which includes:

a first plurality of parallel separated strips, a second plurality of parallel separated strips attached across said first strips to form a square section of lattice with one of said first plurality of strips on one of the diagonals of said square section and one of the second plurality of strips on the other of said diagonals;

a border attached around said section, said border being significantly thinner than said strips;

second, third, and fourth tiles capable of forming one half of an arch with respect to a vertical axis of symmetry, with said second tile adjacent the axis of symmetry, said third tile installed next to said second tile and laterally spaced from the axis, and said fourth tile installed next to and below said third tile, each of said second, third, and fourth tiles comprising a portion of a square section of the kind formed by said first tile, and said second, third, and fourth tiles being arranged with the straight sides of the square sections thereof parallel and perpendicular to said axis, said arch having a center point along said axis at a distance from the top of said second tile equal to twice the length of a side of said square section, and said second, third, and fourth tiles comprising only the portions of said square sections lying outside a circle around said center point;

whereby, additional tiles of the same kind as said second, third, and fourth tiles can be installed symmetrically with respect to said axis to form a full arch, and additional ones of said first tiles can be installed adjacent the square sections of the tiles forming said arch.

* * * * *